US006203067B1

(12) United States Patent
Shipston et al.

(10) Patent No.: US 6,203,067 B1
(45) Date of Patent: Mar. 20, 2001

(54) LINERLESS POSTAGE STAMPS WITH CANCELLATION INK ABSORBING PARTICLES

(75) Inventors: Adele Shipston, Williamsville; David K. Rice, II, Sanborn, both of NY (US)

(73) Assignee: Moore U.S.A., Inc., Grand Island, NY (US)

( * ) Notice: Subject to any disclaimer, the term of this patent is extended or adjusted under 35 U.S.C. 154(b) by 0 days.

(21) Appl. No.: 09/205,699

(22) Filed: Dec. 4, 1998

Related U.S. Application Data

(60) Provisional application No. 60/069,851, filed on Dec. 17, 1997.

(51) Int. Cl.[7] ..... B42D 15/00

(52) U.S. Cl. ..... 283/71; 524/262

(58) Field of Search ..... 283/71; 156/1, 156/187, 247; 427/510, 208.8, 411, 207.1, 208.4, 208.6, 264; 524/262

(56) References Cited

U.S. PATENT DOCUMENTS

| | | | | |
|---|---|---|---|---|
| 4,867,828 | * | 9/1989 | McIntyre | 156/247 |
| 5,083,979 | * | 1/1992 | Burt | 462/3 |
| 5,267,754 | * | 12/1993 | Kaule | 283/71 |
| 5,658,661 | | 8/1997 | Mitchell, Jr. . | |
| 5,663,227 | * | 9/1997 | Birkholz et al. | 524/262 |
| 5,685,570 | | 11/1997 | Gray et al. . | |
| 5,782,496 | * | 7/1998 | Casper et al. | 283/81 |
| 5,792,296 | * | 8/1998 | Soltysiak | 156/184 |
| 5,902,439 | * | 5/1999 | Pike et al. | 156/252 |
| 6,004,630 | * | 12/1999 | Sanchez et al. | 427/515 |

FOREIGN PATENT DOCUMENTS

| | | |
|---|---|---|
| 44 11 571 A1 | 10/1995 | (DE) . |
| 0 747 871 A2 | 12/1996 | (EP) . |

* cited by examiner

*Primary Examiner*—Willmon Fridie, Jr.
(74) *Attorney, Agent, or Firm*—Nixon & Vanderhye PC

(57) ABSTRACT

Linerless postage stamps are produced by coating a paper substrate on the bottom surface with pressure sensitive adhesive, and coating the substrate on the top surface with release material, such as silicone, which includes an effective amount of stamp cancellation ink retaining particles, so that when the release coat and particles are contacted by stamp cancellation ink the particles will retain sufficient stamp cancellation ink so that the ink is visible on the top face and will not be wiped off during normal handling. The particles may comprise fumed silica, colloidal silica, kaolin clay, aluminum oxide, wollastonite, talc, calcium carbonate, titanium dioxide, or combinations thereof. Stamp indicia is typically provided on the top of the substrate underneath the release coat.

20 Claims, 3 Drawing Sheets

LINERLESS POSTAGE STAMPS WITH CANCELLATION INK ABSORBING PARTICLES

CROSS-REFERENCE TO RELATED APPLICATION

This application is based upon provisional 60/069,851, field Dec. 17, 1997.

BACKGROUND AND SUMMARY OF THE INVENTION

It has long been considered desirable to provide linerless postage stamps with pressure sensitive adhesive. Pressure sensitive adhesive postage stamps are becoming increasingly popular, but heretofore have always required a release sheet because if a conventional release liner is applied to the top face of the postage stamp (which is necessary to allow stacking of the stamps or formation into a roll configuration), the cancellation pattern applied by the USPS automated equipment has a tendency to not stick to the top face of the stamp, but rather to be wiped off during further handling, because the cancellation ink cannot be absorbed by, or otherwise retained by, the top face of the stamp. If a very light coating of release material is applied to the top of the stamp, then—particularly if the stamps are not stored under ideal conditions—the adhesive from one stamp may stick to the top face of another causing obliteration of the stamp indicia, making it unsuitable for its intended purpose.

According to the present invention the above mentioned problem is solved and it is possible to produce linerless postage stamps which have a top face that will appropriately hold cancellation ink when applied in a cancellation pattern so that the cancellation pattern is visible and will not wipe off during normal handling.

According to one aspect of the present invention, a method of making a linerless postage stamp from a sheet or web having top and bottom faces is provided. The method comprises: (a) Applying a pressure sensitive adhesive to the bottom face. (b) Applying to the top face a release coat for the adhesive applied in (a) in fluid form with an effective amount of stamp cancellation ink retaining particles therein, so that when the release coat solidifies on the top face and is contacted by stamp cancellation ink the particles will retain sufficient stamp cancellation ink so that the ink is visible on the top face once applied and dried, and will not be wiped off during normal handling. And, (c) forming the web or sheet into separate postage stamps with postage stamp indicia on a top face.

Preferably (c) is practiced by (c1) applying postage stamp indicia to the top face prior to the practice of (b); and (c2) forming lines of weakness in the sheet or web to define the boundaries of separable individual stamps. Typically (c2) is practiced before (b). Desirably (b) is practiced utilizing particles selected from the group consisting essentially of fumed silica, colloidal silica, solid fluoropolymer lubricant, calcium carbonate, and titanium dioxide, or combinations thereof. That is (b) may be practiced by using silicone release coat containing between about 3–7% by weight of the release coat of fumed silica; or (b) may be practiced using silicone release coat containing between about 4–40% by weight of the release coat of colloidal silica. The release coat may be thermo-curable silicone, but preferably is UV curable silicone applied at a weight of between about 0.2–1.5 pounds per ream. Typically the stamp made is a canceled stamp, and the method further comprises applying the adhesive on the bottom face to a mailing piece, and applying cancellation ink in the form of a cancellation image to the top surface of the stamp, the ink absorbed by the particles to provide a visible cancellation image that does not wipe off during normal automated processing and manual handling of the mailing piece.

According to another aspect of the present invention a canceled postage stamp is provided comprising the following the components: A substrate having top and bottom surfaces. Postage stamp indicia imaged on the top face. A pressure sensitive adhesive coating on the bottom face. An adhesive release coat, to which the pressure sensitive adhesive will not non-releasably adhere, on the top face having an effective amount of stamp cancellation ink retaining particles therein. Stamp cancellation ink in a cancellation pattern on the release coat. And, the effective amount of ink retaining particles retaining sufficient stamp cancellation ink so that the pattern is readily visible and the ink is not wiped off during normal handling of a mailing piece containing the substrate. The details of the release coat and particles preferably are as described above.

According to another aspect of the present invention a postage stamp is provided comprising: A paper substrate having top and bottom faces. A pressure sensitive adhesive on the bottom face. Postage stamp indicia on the top face. And, a silicone release material on the top face having more than a trace amount of particles consisting essentially of calcium carbonate, titanium dioxide, fumed silica, kaolin clay, aluminum oxide, wollastonite, talc, and colloidal silica, or combinations thereof. Preferably the details of the release coat, particles, etc., are as described above.

According to yet another aspect of the present invention, a linerless postage stamp assembly is provided comprising: A web of a plurality of postage stamps comprising a substrate material with pressure sensitive adhesive on a first face, and having a second face with release material which will not adhere to the adhesive but will absorb or otherwise retain stamp cancellation ink substantially permanently in sufficient quantity so that a cancellation pattern thereof is clearly visible. The web is a roll configuration with adhesive of one stamp engaging release material of another, each stamp connected to adjacent stamps by lines of weakness. And, stamp cancellation ink absorbing particles provided in the release material.

It is the primary object of the present invention to provide a linerless postage stamp that can effectively retain the cancellation pattern applied thereto. This and other objects of the invention will become apparent from the detailed description of the invention and from the appended claims.

DETAILED DESCRIPTION OF THE DRAWINGS

Figure 1:
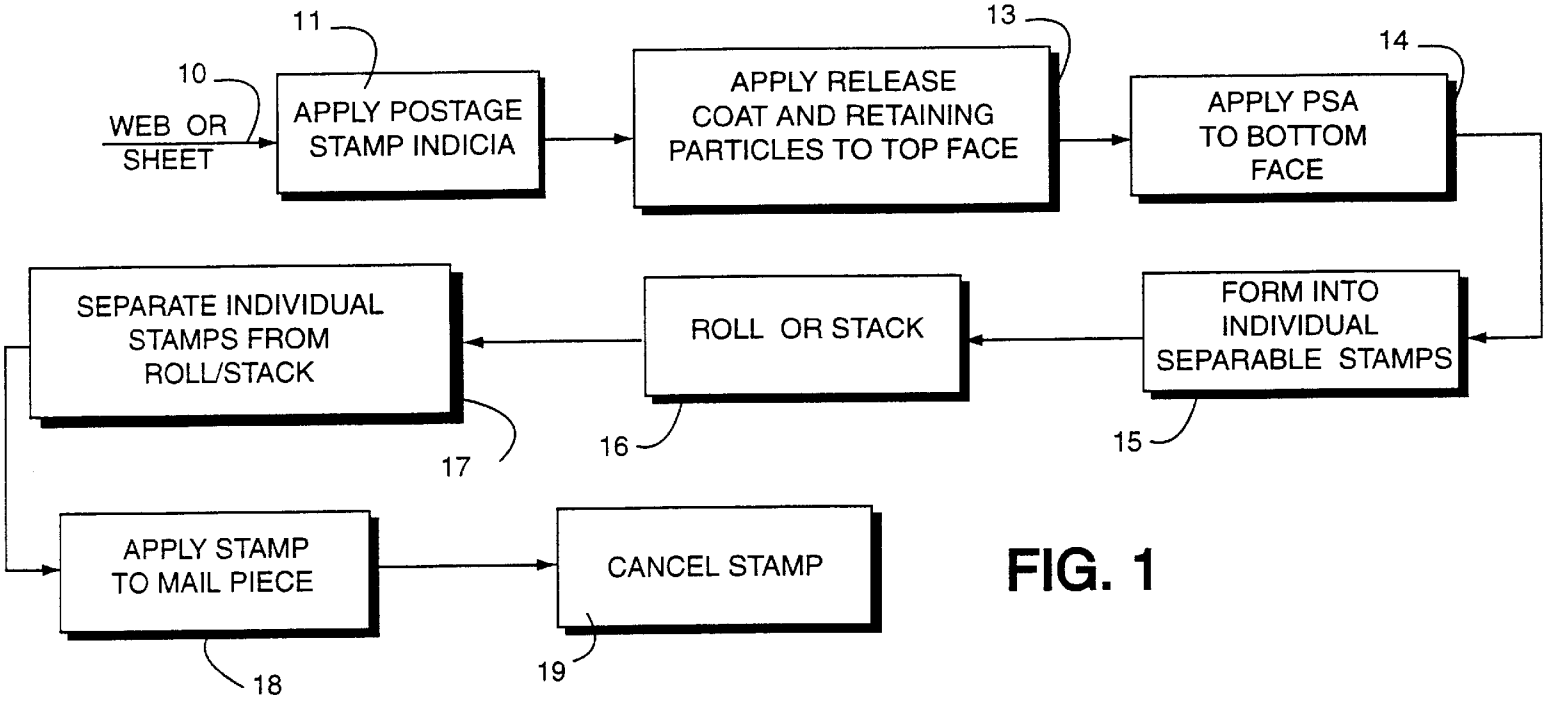
FIG. 1 is a schematic illustration of the exemplary method steps according to the present invention.

FIG. 1 schematically illustrates an exemplary method according to the present invention in which a web or sheet 10 is acted upon to produce postage stamps. The web or sheet 10 forms the substrate for the postage stamps ultimately produced and preferably is of paper or a material with porosity similar to paper. Most desirably the paper has a weight of between about 20–28 pounds per ream, e.g. about 24 pound Union Camp paper.

Typically the first step in the practice of the method schematically illustrated in FIG. 1 (although many of the steps may be revised in order) is the application of postage stamp indicia as indicated by box 11 in FIG. 1 to the top face of the web or sheet 10. Step 13 is the step of applying to the top face a release coat for the adhesive applied later on (in box 14) in fluid form with an effective amount of stamp cancellation ink retaining (e.g. absorbing) particles therein so that when the release coat solidifies on the top face and is contacted by stamp cancellation ink the particles will retain sufficient stamp cancellation ink so that the ink is visible on the top face once applied and dried and will not be wiped off during normal handling by automated processing or manual handling.

The release coat applied at box 13 in FIG. 1 preferably as a UV curable silicone, such as available from General Electric (e.g. UV9300, UV9315, UV9500), Goldschmidt (e.g. RC705, RC708, RC711, RC726), or Rhodia (e.g. PC-600, PC-670, PC702), or combinations thereof. Alternatively, a thermally cured silicone release may be utilized, such as available from Dow (e.g. Syl-off 7600, Syl-off 7044, Syl-off 7900) or Rhodia (e.g. PC105, PC107, PC-267, PC-247), or combinations thereof. Examples of particles that can be used include fumed silica, colloidal silica, kaolin clay, aluminum oxide, wollastonite, talc, calcium carbonate, titanium dioxide, and combinations thereof.

Step 11 is typically practiced by a press or other imaging device, while step 13 is practiced utilizing flexographic techniques, a Gravure press, or a conventional Meyer rod.

The method of FIG. 1 also includes—as indicated by box 14—application of pressure sensitive adhesive to the bottom face of the web or sheet 10. The pressure sensitive adhesive that is applied in box 10 may be any suitable conventional pressure sensitive adhesive, preferably a permanent adhesive like hot melt adhesives (such as Findley 2181), although it also may be a removable or repositional adhesive (such as CLEANTAC 3 adhesive available from Moore U.S.A.). The adhesive may be water-based instead of hot melt, and is applied to the bottom face of the web or sheet 10 using any suitable conventional technique, such as via a slot die.

Box 15 in FIG. 1 indicates the formation of the web or sheet 10 into individual separable stamps. Step 15 may be practiced before step 11, or at almost any other place in the process, and is practiced by providing lines of weakness (such as conventional stamp perforations, die cuts, or the like) in the web or sheet 10 utilizing conventional perforating or die cutting equipment or the like.

After the linerless stamps are produced, they may be formed into a roll or stack as indicated by box 16 in FIG. 1. The roll may be formed by slitting the stamps along the direction of movement of the web or sheet 10 during the practice of the steps 11 through 15, so that the roll is only one stamp wide. The stacking of the sheets may be formed by any conventional technique, and the web may be cut into individual sheets with a plurality of stamps in each sheet before they are stacked.

The roll or stack formed in step 16 is utilized by separating individual stamps from the roll or stack as indicated schematically by box 17 in FIG. 1. The separation may be manually or utilizing conventional automatic equipment. The separated stamp is applied to a mail piece, as indicated at box 18 in FIG. 1, such as an envelope, package, or postcard. The mail piece is mailed and ultimately the stamp is canceled—as indicated by box 19 in FIG. 1—utilizing conventional automatic USPS stamp canceling equipment. The stamp canceling equipment applies a cancellation pattern, with cancellation ink, to the top face of the stamp, while the pressure sensitive adhesive on the bottom face of the stamp is adhered to the mail piece.

Figure 2:
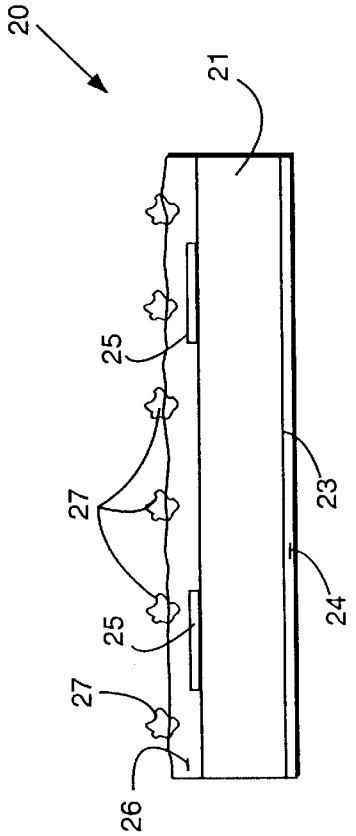
FIG. 2 is a side schematic view, with the components greatly exaggerated in size for clarity of illustration, of an exemplary linerless postage stamp according to the invention.

FIG. 2 is a side cross-sectional view, with the elements thereof greatly exaggerated in thickness and contour for clarity of illustration, of an exemplary linerless stamp according to the invention. The stamp 20 comprises a substrate 21, preferably about 20–28 pound per ream of paper, with a top face 22 and a bottom face 23. On the bottom face 23 is a layer of conventional pressure sensitive adhesive 24, such as hot melt adhesive. On the top face 22 is postal stamp indicia, indicated by reference numeral 25, which typically includes the amount of postage and some sort of design. Applied over the indicia 25 and in contact with the top face 22 is the release coat 26 which includes the cancellation ink absorbing particles 27 therein. Typically the release coat 26, especially if it is a UV curable release coat such as UV curable silicone, has a weight (and is applied at a rate of) between about 0.2–1.5 (e.g. about 0.4–0.5) pounds per ream, a ream in this regard being the paper surface area equivalent of 500 sheets of 17 inch by 22 inch paper.

The particles 27 may comprise colloidal silica particles, e.g. in an amount of, by weight of the release coat 26, between 4–40% (e.g. 10–20%, or any other range within the broad range). One source of colloidal silica may be a stable liquid suspension of colloidal silica and organic medium such as available from Clariant under the trademark "Highlink™ OG Silica Organosol".

Another alternative for the particles 27 is (for a UV curable silicone composition) between about 3–7% by the weight of the release coat 26 of fumed silica, such as available from Cabot under the trade designation L-90. Other possibilities are between about 5–10% by weight of the release coat 26 of conventional calcium carbonate, or between 5–10% by weight of the release coat 26 of conventional titanium dioxide.

Figure 3:
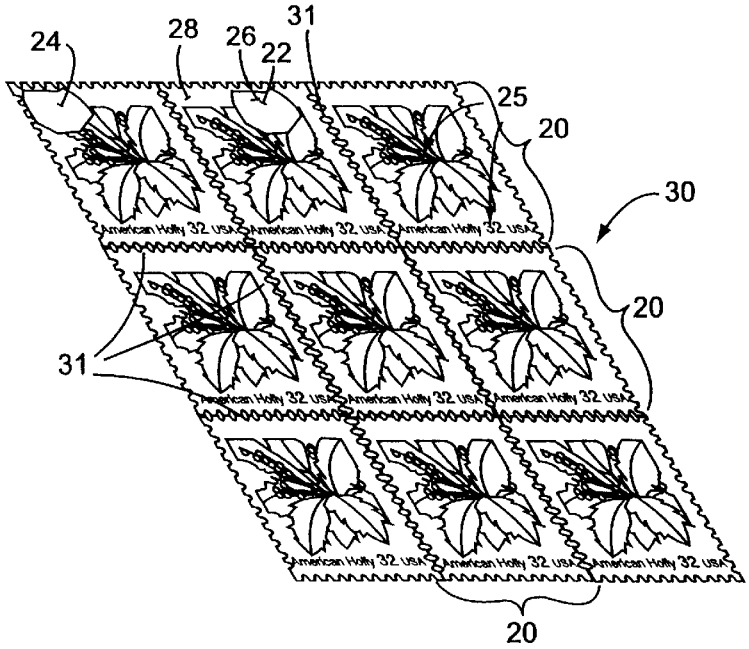
FIG. 3 is a top perspective view of a sheet of individual stamps according to the present invention.

FIG. 3 illustrates a sheet 30 of individual stamps 20 according to the invention, each of the individual stamps 20 being separated from each other by conventional lines of weakness 31, in this case perforation lines. The upper left corner of the cut off end of the sheet 30 is shown turned back to illustrate the pressure sensitive adhesive 24 on the bottom face 23 thereof. When the sheets 30 are stacked in a stack, the pressure sensitive adhesive 24 from one sheet 30 will not adhere to the release coat 26 on the underlying sheet 30.

Figure 4:
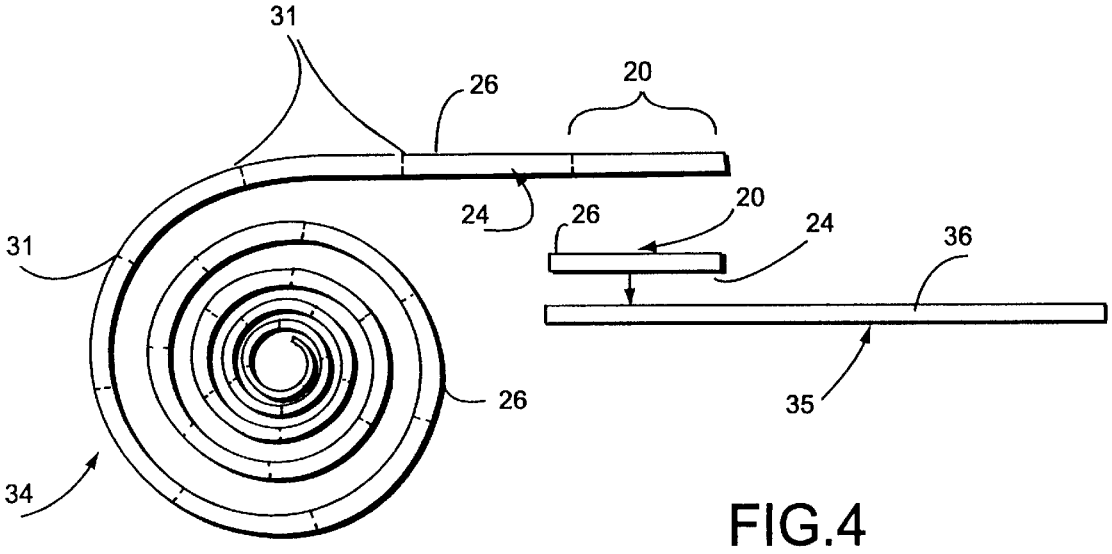
FIG. 4 is a side schematic illustration of a postage stamp assembly according to the present invention in a rolled configuration.

FIG. 4 schematically illustrates a postage stamp assembly according to the present invention in roll configuration, shown generally by reference numeral 34 in FIG. 1. The roll is one stamp wide with each of the stamps 20 again being separated by lines of weakness such as perforation lines 31. In the roll configuration 34 the pressure sensitive adhesive 24 from the outer stamps engage the release coat 26 of the inner stamps, and they do not stick together.

Figure 5:
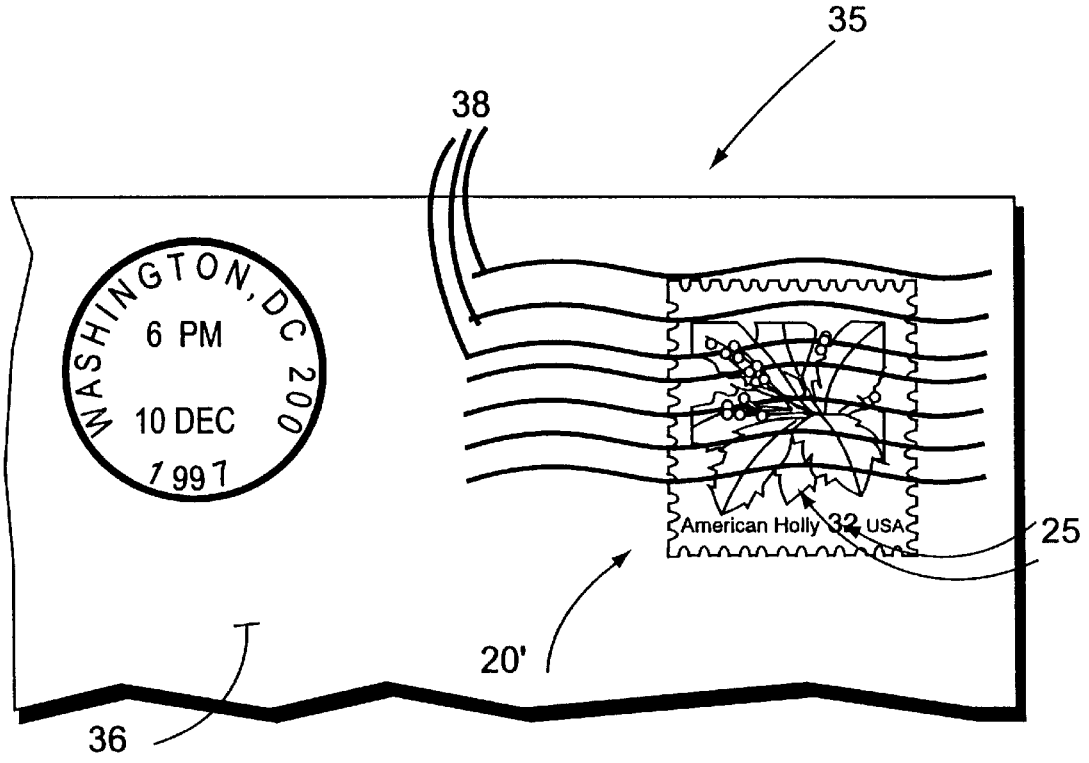
FIG. 5 is a top detail view of an envelope with canceled stamp according to the present invention.

FIG. 4 also schematically illustrates a postage stamp 20 being applied to a mail piece 35, such as an envelope, package, or postcard. The pressure sensitive adhesive 24 of the stamp 20 is applied to the addressed surface 36 of the mail piece 35, pressure causing the adhesive 24 to securely adhere to the face 36, and in fact permanently adhere if the adhesive 24 is a conventional permanent adhesive. The mailing piece 35 is subsequently mailed, and processed by the USPS. During processing, utilizing conventional equipment, a cancellation pattern is applied over the stamp 20 using cancellation ink. For example FIG. 5 shows a canceled version 20' of the stamp 20 of FIG. 4 on the mailing piece 35 after the cancellation pattern/ink 38 is applied thereto.

Because of the particles 27 and the release coat 26, the cancellation pattern/ink 38 is clearly visible on the stamp 20' and is not wiped off during normal automated processing and manual handling of a mailing piece 35.

The cancellation ink in pattern 38 is typically that available from American Coding and Marking Co. referenced as USPS 914M2B Cancellation Ink.

While the invention has been herein shown and described in what is presently conceived to be the most practical and preferred embodiment it is apparent to those of ordinary skill in the modified that many modifications may be made thereof within the scope of the invention which scope is to be accorded the broadest interpretation of the appended claims so as to encompass all equivalent processes and products.

What is claimed is:

1. A method of making a linerless postage stamp from a sheet or web having top and bottom faces comprising:

(a) applying a pressure sensitive adhesive, to the bottom face;

(b) applying to the top face a release coat for the adhesive applied in (a) in fluid form with an effective amount of stamp cancellation ink retaining particles therein selected from the group consisting essentially of fumed silica, colloidal silica, kaolin clay, aluminum oxide, talc, wollastonite, and titanium dioxide, or combinations thereof, so that when the release coat solidifies on the top face and is contacted by stamp cancellation ink the particles will retain sufficient stamp cancellation ink so that the ink is visible on the top face once applied and dried, and will not be wiped off during normal handling; and (c) forming the web or sheet into separate postage stamps with postage stamp indicia on a top face.

2. A method as recited in claim 1 wherein (c) is practiced by (c1) applying postage stamp indicia to the top face prior to the practice of (b); and (c2) forming lines of weakness in the sheet or web to define the boundaries of separable individual stamps.

3. A method as recited in claim 2 wherein (c2) is practiced before (b).

4. A method as recited in claim 1 wherein (b) is practiced using silicone release coat containing between about 3–7% by weight of the release coat of fumed silica.

5. A method as recited in claim 1 wherein (b) is practiced using silicone release coat containing between about 4–40% by weight of the release coat of colloidal silica.

6. A method as recited in claim 4 wherein (b) is further practiced using a UV curable silicone release coat applied at a weight of between about 0.2–1.5 pounds per 17 inch by 22 inch by 500 sheet ream of paper as the web or sheet.

7. A method as recited in claim 5 wherein (b) is further practiced using a UV curable silicone release coat applied at a weight of between about 0.2–1.5 pounds per 17 inch by 22 inch by 500 sheet ream of paper as the web or sheet.

8. A method as recited in claim 1 wherein the stamp is a canceled stamp, and further comprising applying the adhesive on the bottom face to a mailing piece, and applying cancellation ink in the form of a cancellation image to the release coat on the top surface of the stamp so that a sufficient quantity of the ink is retained by the retaining particles therein so that the cancellation image is visible and is not wiped off during normal automated processing and manual handling of the mailing piece.

9. A canceled postage stamp comprising:

a substrate having top and bottom surfaces;

postage stamp indicia imaged on said top face;

a pressure sensitive adhesive coating on said bottom face;

an adhesive release coat, to which said pressure sensitive adhesive will not non-releasably adhere, on said top face having an effective amount of stamp cancellation ink retaining particles therein, and wherein said release coat is selected from the group consisting essentially of UV curable silicone and thermally curable silicone with thermo cured catalyst;

stamp cancellation ink in a cancellation pattern on said release coat; and said effective amount of ink retaining particles retaining sufficient stamp cancellation ink so that said pattern is readily visible and said ink is not wiped off during normal handling of a mailing piece containing said substrate.

10. A canceled postage stamp as recited in claim 9 wherein said release coat is UV cured silicone applied at a weight of between about 0.2–1.5 pounds per 17 inch by 22 inch by 500 sheet ream of substrate sheets.

11. A canceled postage stamp as recited in claim 10 wherein said particles are selected from the group consisting essentially of, titanium dioxide, kaolin clay, aluminum oxide, wollastonite, talc, fumed silica, and colloidal silica, or combinations thereof.

12. A canceled postage stamp as recited in claim 10 wherein said particles comprise fumed silica in the amount of between about 3–7% by weight of the silicone release coat.

13. A canceled postage stamp as recited in claim 10 wherein said particles comprise colloidal silica in the amount of between about 4–40% by weight of the silicone release coat.

14. A canceled postage stamp as recited claim 9 and wherein said particles are selected from the group consisting essentially of, titanium dioxide, kaolin clay, aluminum oxide, wollastonite, talc, fumed silica, and colloidal silica, or combinations thereof.

15. A postage stamp comprising:

a paper substrate having top and bottom faces;

a pressure sensitive adhesive on said bottom face;

postage stamp indicia on said top face; and a silicone adhesive release material on said top face, said silicone release material having a top surface, and having more than a trace amount of particles consisting essentially of, titanium dioxide, kaolin clay, aluminum oxide, wollastonite, talc, fumed silica, and colloidal silica, or combinations thereof, disposed at said top surface of said silicone release material.

16. A postage stamp as recited in claim 15 wherein said adhesive release material comprises silicone release material applied at a weight of between about 0.2–1.5 pounds per 17 inch by 22 inch by 500 sheet ream of substrate paper.

17. A postage stamp as recited in claim 15 wherein said particles comprise fumed silica in the amount of between about 3–7% by weight of the silicone release coat.

18. A postage stamp as recited in claim 15 wherein said particles comprise colloidal silica in the amount of between about 4–40% by weight of the silicone release coat.

19. A linerless postage stamp assembly comprising:

a web of a plurality of postage stamps comprising a substrate material with pressure sensitive adhesive on a first face, and having a second face with release material which will not adhere to said adhesive but will absorb or otherwise retain stamp cancellation ink substantially permanently in sufficient quantity so that a cancellation pattern thereof is clearly visible;

said release material including ink retaining particles selected from the group consisting essentially of, titanium dioxide, kaolin clay, aluminum oxide, wollastonite, talc, fumed silica, and colloidal silica, or combinations thereof;

said web is a roll configuration with adhesive of one stamp engaging release material of another, each stamp connected to adjacent stamps by lines of weakness; and stamp cancellation ink absorbing particles provided in said release material.

20. A canceled postage stamp as recited in claim 9 wherein said adhesive release coat has a top surface, and wherein said particles are disposed at said top surface of said adhesive release coat.

* * * * *